United States Patent [19]

Holdeman

[11] Patent Number: 5,066,168

[45] Date of Patent: Nov. 19, 1991

[54] CYLINDRICAL FOUNDATION SUPPORT DRIVABLE INTO GROUND WITH REMOVABLE HELIX

[75] Inventor: Maynard L. Holdeman, Centralia, Mo.

[73] Assignee: A.B. Chance Company, Centralia, Mo.

[21] Appl. No.: 664,944

[22] Filed: Mar. 5, 1991

[51] Int. Cl.[5] ..... E02D 7/28

[52] U.S. Cl. ..... 405/249; 52/155; 52/157; 405/245

[58] Field of Search ..... 405/229, 231, 232, 244, 405/245, 249; 52/155, 156, 157, 165

[56] References Cited

U.S. PATENT DOCUMENTS

| | | | |
|---|---|---|---|
| 3,436,921 | 4/1969 | Gauntt et al. | 405/249 |
| 4,637,758 | 1/1987 | Tamaki et al. | 405/232 X |

FOREIGN PATENT DOCUMENTS

| | | | |
|---|---|---|---|
| 62217 | 4/1983 | Japan | 405/245 |
| 222212 | 12/1983 | Japan | 405/245 |
| 2154630 | 9/1985 | United Kingdom | 405/245 |

*Primary Examiner*—David H. Corbin

*Attorney, Agent, or Firm*—Hovey, Williams, Timmons & Collins

[57] ABSTRACT

A combined foundation earth anchor and installation unit includes a cylindrical foundation support which is open at opposite ends and adapted to at least partially be embedded in the ground, an installation drive component removably positioned within the support and provided with an element extending longitudinally through the support and projecting outwardly from one end thereof, and a connector for releasably coupling the installation drive component to the support, so that upon rotational movement of the drive component, the support is rotated therewith. The installation drive component includes a drive helix on the end of the element which projects outwardly from one end of the support, so that upon application of a rotational force to the assembled foundation support and drive component, while a downward force is applied to such assembly, the drive helix causes the support and drive assembly to be pulled into the ground. The installation drive component element which extends outwardly from one end of the support has a guide structure which is engageable with the support for maintaining axial alignment between the support and the drive component during installation. The guide structure cooperates with the drive helix to cause the foundation and drive component assembly to be drawn into the ground during the application of rotational force to the support and drive component assembly. When the support has been driven into the ground to the desired level, the drive component may be disconnected from the support and removed by reverse rotation thereof, leaving the foundation support in the ground. A method of at least partially embedding an open-ended cylindrical earth anchor in the ground is also disclosed.

16 Claims, 1 Drawing Sheet

Fig. 1.
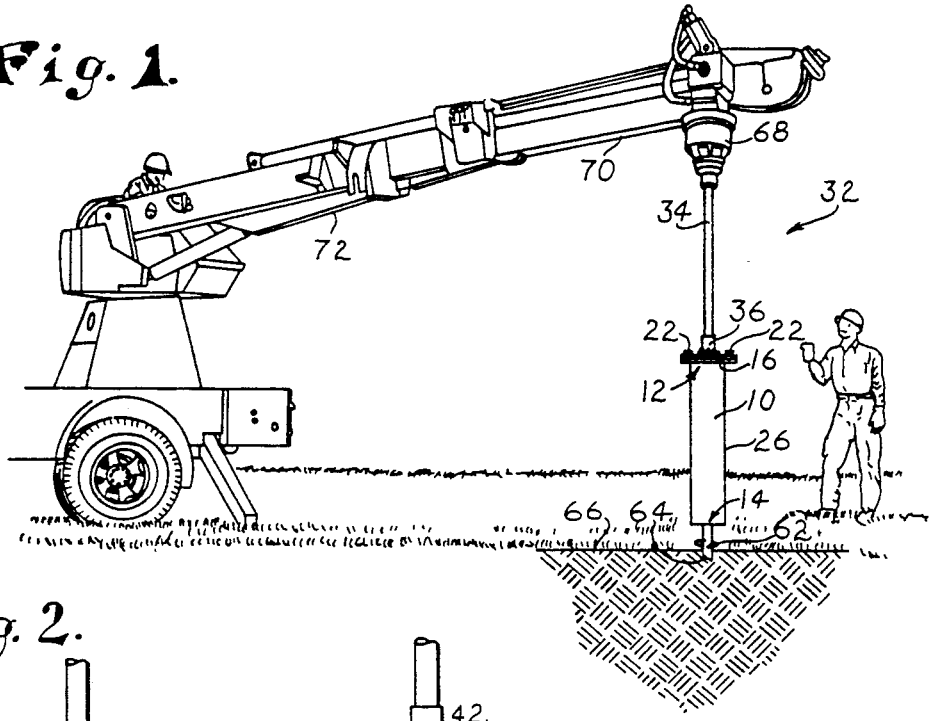
Fig. 2.
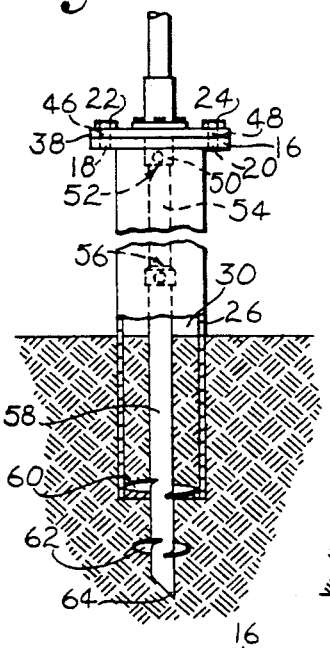
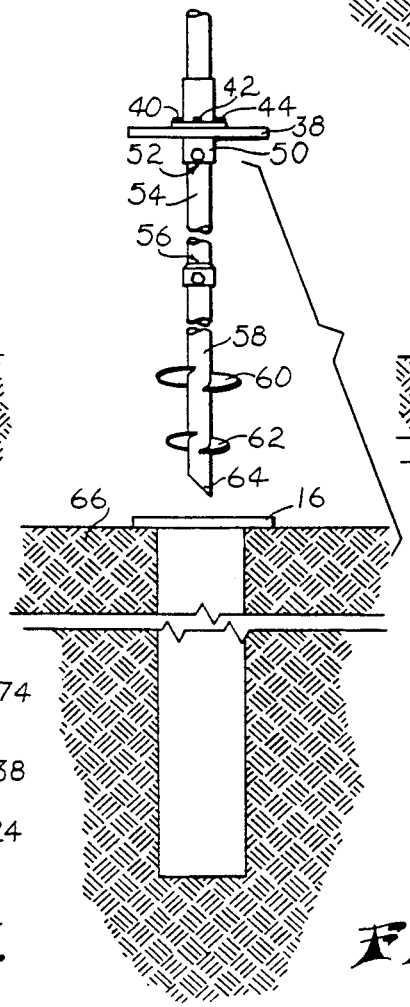
Fig. 3.
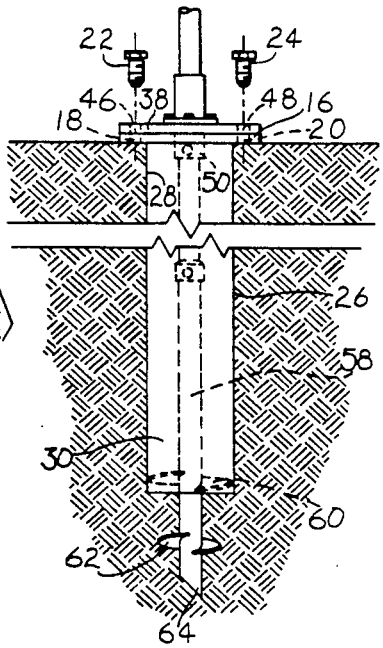
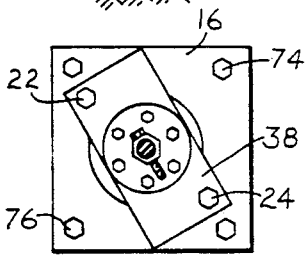
Fig. 5.
Fig. 4.

CYLINDRICAL FOUNDATION SUPPORT DRIVABLE INTO GROUND WITH REMOVABLE HELIX

BACKGROUND OF THE INVENTION

1. Field of the Invention

The present invention relates generally to devices for driving cylindrical foundation support elements into the ground by means of a helical drive structure, and in particular to a method and apparatus for driving a cylindrical foundation support into the ground through the use of an installation drive component having respective guide and driving helices, which is releasably attached and inserted into the cylindrical foundation support and may be withdrawn from it following insertion thereof to the desired depth, so that the installation drive component may be used repeatedly for the same purpose.

2. Discussion of the Prior Art

It is known to provide a cylindrical foundation support element having an open lower end and which may be rotatably driven into the ground by virtue of the provision of an integral annular helix permanently affixed to the outer surface of the lower end of the support. The helix has an earth penetrating edge, and in conjunction with the cylindrical foundation defines an opening through which soil is allowed to pass into the chamber formed by the cylindrical wall of the foundation support. The opposite end of the cylindrical foundation support is adapted for releasable locking engagement to a drive element, which is used to rotate the support in a given direction, thus driving the support into the ground to a desired depth.

The existing cylindrical foundation supports of the type above described have several shortcomings. As mentioned, such supports are presently of a standard length, in part due to the manufacturing costs associated with constructing the support with an integral drive helix. This fact limits the use of such supports, to the extent that they are not always adapted to the particular soil conditions that may be encountered.

A second disadvantage manifested in the known examples is that the incorporation of the helix with the foundation support means that the combination may only be used once. That is, the potential value of the drive helix, which might be used repeatedly for such applications, is entirely lost because the helix is essentially disposed of by remaining buried with the support.

Another problem with such known structures is the cost that must be built into the price of such supports and which is directly attributable to the inclusion of a fixed felical drive member. Considerable cost savings may be realized from the manufacture of more simple cylindrical foundation supports that have no fixed drive helix.

SUMMARY OF THE INVENTION

It is an object of the present invention to provide a cylindrical foundation earth anchor and installation unit which facilitates at least partial embedment of the foundation in the ground, while at the same time allowing complete removal of the installation unit for reuse in driving another cylindrical foundation support into the ground.

Another object of the invention is to provide a foundation earth anchor and installation unit wherein the installation unit comprises an installation drive component positioned within the support and having a longitudinally extending element that projects outwardly from one end of the support. The installation drive component is releasably coupled to the support so that upon rotational movement of the drive component, the support is corotated.

A further object of the invention is to provide such a foundation earth anchor and installation unit in which the installation drive component includes at least one helix on the end of the element that projects outwardly from one end of the support, to the end that upon application of rotational force to the coupled support and drive component, while a downward force is also applied, the helix causes the support and drive component to be pulled into the ground.

It is yet another object of the invention to provide a foundation earth anchor and installation unit wherein the drive component element projecting outwardly from one end of the support has a guide means that may be engaged with the support in order to maintain axial alignment between the support and the drive component during installation of the foundation, and that cooperates with the end helix to cause the support and drive component to be drawn into the ground during rotation thereof.

It is another object of the invention to provide a combined foundation earth anchor and installation unit wherein the drive component may be disconnected from the support and removed by rotation thereof in a direction opposite to the direction of installation, after the support has been forced into the ground to a desired level. In the present invention the foundation support will thereby be left in the ground.

Another object of the invention is to provide a method for at least partially embedding an open-ended cylindrical earth anchor into the ground by means of the combination foundation earth anchor and installation unit above described.

In accordance with the invention, a cylindrical foundation support having open opposite ends may be manufactured of a variety of desired lengths. The support is constructed of such substantial material, such as steel, as will allow it to be at least partially buried in the ground on a permanent basis. The support is adapted to be at least partially embedded in the ground by use of an installation unit which is removably positioned longitudinally within the support so that an element of the installation unit projects outwardly from one end of the support. The installation unit is releasably coupled to the other end of the support, whereby upon rotational movement of the drive component, the support is rotated therewith. The installation unit element which extends outwardly from one end of the support has a helix on its end, and a helical guide means engagable with the foundation support for maintaining axial alignment between the support and the drive component during installation of the foundation. In this configuration, when rotational force in a first direction is applied to the coupled support and drive component, and downward force thereon is simultaneously applied, the helix on the element causes the support and drive component to be pulled into the ground. After the support and drive component are embedded in the ground to a desired depth, the drive component may be disconnected from the support and removed by rotation thereof in a direction opposite to the first rotation direction, leaving the foundation support in the ground.

BRIEF DESCRIPTION OF THE DRAWINGS

A preferred embodiment of the invention is described in detail below with reference to the attached drawing figures, wherein:

FIG. 1 is a side elevation view of a combination foundation earth anchor and installation unit apparatus, constructed in accordance with the preferred embodiment;

FIG. 2 is a side elevation view of the combination foundation earth anchor and installation unit apparatus of FIG. 1, with a portion broken away to show detail of the installation unit.

FIG. 3 is a side elevation view of the combination foundation earth anchor and installation unit apparatus of FIG. 1.

FIG. 4 is a side elevation view of the combination foundation earth anchor and installation unit apparatus of FIG. 1, with the installation unit withdrawn from the cylindrical foundation support to show detail.

FIG. 5 is a top plan view showing detail of the releasable locking engagement of the foundation earth anchor and installation unit combination, constructed in accordance with the preferred embodiment.

DETAILED DESCRIPTION OF THE PREFERRED EMBODIMENT

A combination foundation earth anchor and installation unit apparatus constructed in accordance with a preferred embodiment of the present invention is illustrated in FIG. 1. It includes a cylindrical foundation support 10 having a first end 12 and second end 14. The cylindrical foundation support 10 is further provided with a square drive plate 16 adjacent end 12 thereof. The square drive plate 16 may have more than one pair of openings, and is generally adapted for locking engagement with the base of, for example, a highway light standard (not shown). As shown in FIGS. 2 and 3, the drive plate 16 is constructed with at least of a pair of opposed openings 18 and 20 adapted to receive bolts 22 and 24. The support 10 has a cylindrical outer wall 26 and an inner wall 28 which forms an enclosed chamber 30.

An installation drive component 32 includes a drive element 34. The drive element 34 is releasably engaged to a drive element adapter upper portion 36. The drive element adapter upper portion 36 is attached to a releasable coupler 38 by bolts 40, 42 and 44. The releasable coupler 38 has openings 46 and 48, spaced apart for alignment with drive plate openings 18 and 20 respectively, and adapted to receive bolts 22 and 24. As shown in FIGS. 2 and 4, a drive element adapter lower portion 50 extends downwardly from the releasable coupler 38 into the enclosed chamber 30. In the illustrated example, the drive element adapter lower portion 50 is engaged with a first end 52 of drive element extension 54 extending longitudinally into the enclosed chamber 30. The drive element extension 54 also has a second end 56.

FIGS. 2–4 illustrate that the installation drive component 32 also includes an earth anchor 58 attached to the drive element extension second end 56 and extending downwardly through the support second end 14. The earth anchor 58 has a guide helix 60 and a drive helix 62 in spaced apart relation to each other. The earth anchor 58 includes a tip 64, and as illustrated in FIG. 1, the tip 64 is adapted to pierce a ground surface 66.

FIG. 1 illustrates the operation of the combination foundation earth anchor and installation unit. The installation drive component 32 is positioned within and releasably coupled to the cylindrical foundation support 10. This is acheived by aligning the releasable coupler 38 with the drive plate 16 so that the drive plate openings 18 and 20 are in alignment with the coupler openings 46 and 48 respectively. Bolt 22 is inserted through aligned openings 18 and 46, and in like manner bolt 24 is inserted through aligned openings 20 and 48 to secure the releasable engagement of the support 10 with the installation drive component 32.

As shown in FIG. 1, drive element 34 is directly connected to a power source for rotational movement, in this particular instance a winch 68. In the illustrated example, the winch 68 is located at a moveable end 70 of an extensible boom 72. This arrangement allows for the invention to be used in a wide variety of topographical situations. FIG. 1 illustrates that the invention is properly used by placing the combination earth anchor and installation unit so that it is vertical to the ground surface, whereby downward pressure from the boom 70 can be applied to the apparatus while rotational movement is simultaneously applied to the apparatus by the winch 68. In this illustration, the drive element tip 64 is properly shown to have pierced the ground surface 66.

FIG. 2 illustrates the apparatus partially embedded in the ground, as the downward and rotational forces continue to be exerted upon it. As the apparatus is urged into the ground by the downward pressure of the boom 70, the drive helix 62 rotates to pull the apparatus deeper into the soil. FIG. 2 illustrates that the guide helix 60, which is contained within the enclosed chamber 30 at the second end 14 of the support 10, is engaged with the support inner wall 28. In this configuration, the guide helix 60 maintains the installation drive component 32 in axial alignment with the support 10 while at the same time aiding the drive helix 62 by moving the soil in the enclosed chamber 30 toward the support first end 12.

In FIG. 3, the combination foundation earth anchor and installation unit is shown fully embedded in the ground. Thus, the drive plate 16 has been brought flush with the ground surface 66, preferably such that the apparatus is fully embedded in a posture that is vertical to the ground surface. In this condition, the apparatus is in proper condition for removal of the installation unit from the foundation earth anchor. In this illustration, the first step for such withdrawal is shown, namely the extraction of bolt 22 from aligned openings 18 and 46, followed by the extraction of bolt 24 from aligned openings 20 and 48.

Turning to FIG. 4, the installation drive component 32 is shown completely withdrawn from cylindrical foundation support 10. With the bolts 22 and 24 extracted as illustrated in FIG. 3, the drive component 32 is urged upward by the boom 70. Simultaneously, rotational movement is imparted to the installation drive component 32 by the winch 68 in a direction opposite to the rotational direction utilized to drive the apparatus into the ground. The combination of the reversed rotational movement and the upward pressure by the boom 70 causes the entire installation drive component 32 to be fully extracted from the support 10. Because the removal of the drive component 32 is accomplished by simple reversal of the forces first used to drive the apparatus into the ground, the support 10 is substantially undisturbed and in proper position for utilization.

FIG. 5 illustrates, in a top plan view, the locking engagement of the drive plate 16 with the coupler 38. As previously described, bolts 22 and 24 extend through coupler openings 46 and 48 respectively, and thence also through drive plate openings 16 and 18. In this illustration, openings 74 and 76 are shown. After full insertion of the support 10, drive plate 16 is adapted for supporting connection to, for example, a highway light standard. Openings 74 and 76 would accommodate locking bolts.

In accordance with the invention, the preferred method of at least partially embedding an open-ended cylindrical earth anchor in the ground includes the steps of removably positioning the installation drive component 32 within the enclosed chamber 30 of the support 10, in such manner that the earth anchor 58, including the drive helix 62, projects outwardly from the second end 14 of the support 10. When this is done, the installation drive component 32 is releasably coupled to the support 10, and the assembled installation drive component 32 and support 10 are positioned so that the drive element tip 64 is in contact with the ground surface 66 at the point where the support 10 is to be embedded.

With the apparatus in this posture, downward force is applied to it by the boom 70, while rotational torque in a first direction is applied by the winch 68 to the installation drive component 32, causing the drive helix 62 to pull the combined apparatus into the ground. While this is done, the support 10 and installation drive component 32 are maintained in axial alignment by the engagement of the guide helix 60 with the support inner wall 28. When the apparatus is embedded in the ground to a desired depth, the installation drive component 32 is disconnected from the support 10, and removed therefrom by rotating the installation drive component 32 in a second direction opposite to the direction used in driving the apparatus into the ground, while the boom 70 exerts an upward force on the apparatus. In this manner, the support 10 is left in the ground at the desired depth.

Although the invention has been described with reference to the illustrated preferred embodiment, it is noted that variations and changes may be made and equivalents employed herein without departing from the scope of the invention as recited in the claims.

What is claimed is:

1. In a foundation earth anchor and installation unit, the combination comprising:

a cylindrical foundation support which is open at opposite ends thereof and adapted to at least partially be embedded into the ground;

an installation drive component removably positioned within the support and provided with an element extending longitudinally of the support and projecting outwardly from one end thereof; and means for releasably coupling the installation drive component to the foundation support whereby upon rotational movement of the drive component, the foundation support is rotated therewith, said installation drive component further including helix means on the end of the element which projects outwardly from said one end of the support so that upon application of a rotational force to the assembled foundation support and drive component while a down force is applied to such assembly, the helix means on the element causes the support and drive assembly to be pulled into the ground, and guide means on the element and engagable with the foundation support for maintaining axial alignment between the foundation support and the drive component during installation of the foundation and cooperable with said helix means to cause the foundation and drive component to be drawn into the ground during rotation of the foundation support and drive component assembly, whereby after the foundation support has been forced into the ground to a desired level, the drive component may be disconnected from the foundation support and removed by rotation thereof in a direction opposite to the direction of installation of rotation leaving the foundation support in the ground.

2. In a foundation earth anchor and installation unit as set forth in claim 1, wherein the outer surface portion of the foundation support adapted to be embedded in the ground presents a relatively smooth outer cylindrical surface.

3. In a foundation earth anchor and installation unit as set forth in claim 2, wherein said guide means comprises second helix means on the element.

4. In a foundation earth anchor and installation unit herefor as set forth in claim 3, wherein said second helix means has an effective outer diameter such that at least a part of the second helix means engages the inner surface of the foundation support to maintain said axial alignment between the foundation support and the drive component.

5. In a foundation earth anchor and installation unit as set forth in claim 4, wherein the second helix means has an effective outer diameter essentially equal to the inner diameter of the foundation support.

6. In a foundation earth anchor and installation unit as set forth in claim 5, wherein the helix means on the end of the drive component normally projecting outwardly from said one end of the foundation support is of an effective diameter less than the effective diameter of the second helix means.

7. In a foundation earth anchor and installation unit as set forth in claim 1, wherein said means for releasably coupling the installation drive component to the foundation support includes flange means on the foundation support and projecting outwardly from the support at the end thereof opposite said one end of the same, and structure for releasably connecting said element of the installation drive component to the flange means on the support element.

8. In a foundation earth anchor and installation unit as set forth in claim 1, wherein said element includes an elongated shaft, said helix means including a first helix integrally secured to said shaft.

9. In a foundation earth anchor and installation unit as set forth in claim 8, wherein said guide means includes a second helix integrally secured to said shaft in spaced relationship from the first helix and of a diameter to engage the inner surface of the foundation shaft for maintaining said axial alignment between the foundation support and the drive component.

10. In a foundation earth anchor and installation unit as set forth in claim 9, wherein said shaft has an extension portion releasably connected thereto in a direction away from said first and second helices whereby an extension portion may be connected to the shaft of a length which is correlated with the length of the foundation support.

11. In a foundation earth anchor and installation unit as set forth in claim 1, wherein said element is of significantly less transverse dimensions than the internal diameter of the foundation support to minimize disturbance of the soil within the foundation support during driving thereof into the ground.

12. A method of at least partially embedding an open-ended cylindrical earth anchor in the ground comprising the steps of:

removably positioning an installation drive component in the foundation support of a type having an element extending longitudinally of the support and projecting outwardly from one end thereof, and helix means on the end of the element projecting outwardly from the support;

releasably coupling the installation drive component to the foundation support;

positioning the assembled foundation support and drive component in disposition such that the extremity of the drive component is at the ground location where the foundation support is to be embedded;

applying a rotational torque in a direction and a down force on the drive component to cause the helix on the drive component element to pull the drive component and thereby the foundation support into the ground;

maintaining the foundation support and drive component in substantial axial alignment while the drive component and the foundation support are being driven into the ground;

disconnecting the drive component from the foundation support after the latter has been driven into the ground to a desired depth; and removing the drive component from the foundation support while leaving such support in the ground at said desired depth by rotating the drive component in the opposite direction while applying an up force thereon.

13. A method of at least partially embedding an open-ended cylindrical earth anchor in the ground as set forth in claim 12, wherein is included the step of providing a foundation support having a generally smooth outer cylindrical surface.

14. A method of at least partially embedding an open-ended cylindrical earth anchor in the ground as set forth in claim 12, wherein said step of maintaining the foundation support and drive component in substantial axial alignment while the drive component and the foundation support are being driven into the ground includes the step of locating the helix means on the drive component in disposition to engage the inner surface of the foundation support and maintain such axial alignment.

15. A method of at least partially embedding an open-ended cylindrical earth anchor in the ground as set forth in claim 12, wherein the step of removing the drive component from the foundation support includes rotating the drive component in said opposite direction at a rate while applying an up force thereon of a magnitude to minimize distrubance of the soil within the interior of the at least partially embedded foundation support.

16. A method of at least partially embedding an open-ended cylindrical earth anchor in the ground as set forth in claim 12, wherein the foundation support is provided with a flange on the end thereof normally remote from the helix bearing extremity of the drive component and wherein is included the step of driving the foundation support into the ground only to a depth such that the flange on the foundation support is accessible for attachment of the member which is to be ultimately carried by the foundation support.

* * * * *